United States Patent [19]

Bowling

[11] Patent Number: 4,551,589

[45] Date of Patent: Nov. 5, 1985

[54] VARIABLE POWER CONTROL DEVICE

[76] Inventor: Teamus Bowling, 4310 Starlite La., Louisville, Ky. 40291

[21] Appl. No.: 587,829

[22] Filed: Mar. 9, 1984

[51] Int. Cl.[4] ..... H01H 7/00

[52] U.S. Cl. ..... 200/38 A; 200/38 BA

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E

[56] References Cited

U.S. PATENT DOCUMENTS 3,610,848 10/1971 Rosenberg ..... 200/38 B

*Primary Examiner*—A. D. Pellinen
*Assistant Examiner*—Morris Ginsburg
*Attorney, Agent, or Firm*—Jon C. Winger

[57] ABSTRACT

A variable power control device for varying the operating duty cycle to an electrical load such as an electrical heating unit, for example, an electrical cooking range, heating pad and the like. The control device can be used to adjust the on time of the electrical load or the temperature of the electrical load. The control device includes a cycling cam which rotates at a constant velocity, and a rotatable movable adjustment cam. A cycling electrical contact switch is located with one contact thereof disposed to follow the contour of the cycling cam and the other contact thereof disposed to follow the contour of the adjustment cam. An on-off of electrical contact switch is associated with an on-off cam with one contact disposed to follow the contour of the on-off cam and the other contact being stationary.

19 Claims, 10 Drawing Figures

VARIABLE POWER CONTROL DEVICE

BACKGROUND OF THE INVENTION

The present invention relates to adjustable timing devices for activating electrical switch contacts.

One object of the present invention is to provide an adjustment variable power control device which is capable of controlling the electrical power to a plurality of electrical loads independently of one another.

Another object of the present invention is to provide an adjustable variable power control device which is compact in size A further object of the present invention is to provide an adjustable variable power control device which is relatively simple in construction and, therefore, reliable in operation Still another object of the present invention is to provide an adjustable variable power control device which will not drift from the set calibration Yet another object of the present invention is to provide an adjustable variable power control unit which is capable of controlling power at low power settings Other objects of the present invention are to provide an adjustable variable power control device which is not effected by ambient temperature changes, not effected by applied voltage variances, and not effected by electrical load variances

SUMMARY OF THE INVENTION

The present invention provides an adjustable variable power control unit for controlling the electrical power to an electrical load by varying the operating duty cycle, comprising electrical cycling contact switch means; rotatable cycling cam means operatively associated with the cycling contact switch means for opening and closing the cycling contact switch means as a function of the development of the cam surface of the cycling cam means; motor means for rotating the cycling cam means at a constant angular velocity; on-off contact switch means operatively associated with the motor means rotatable cam means operatively associated with the on-off contact switch means for opening and closing the on-off switch means: and, rotatable adjustment cam means operatively associated with the cycling contact switch means for adjusting the gap between the contacts of the cycling contact switch means as a function of the development of the cam surface of the adjustment cam means

BRIEF DESCRIPTION OF THE DRAWINGS

The various objects and features of the present invention will become even more clear upon reference to the following description in conjunction with the accompanying drawings in which like numerals refer to like parts throughout the several views and wherein.

DETAILED DESCRIPTION OF THE PREFERRED EMBODIMENT

Figure 1:
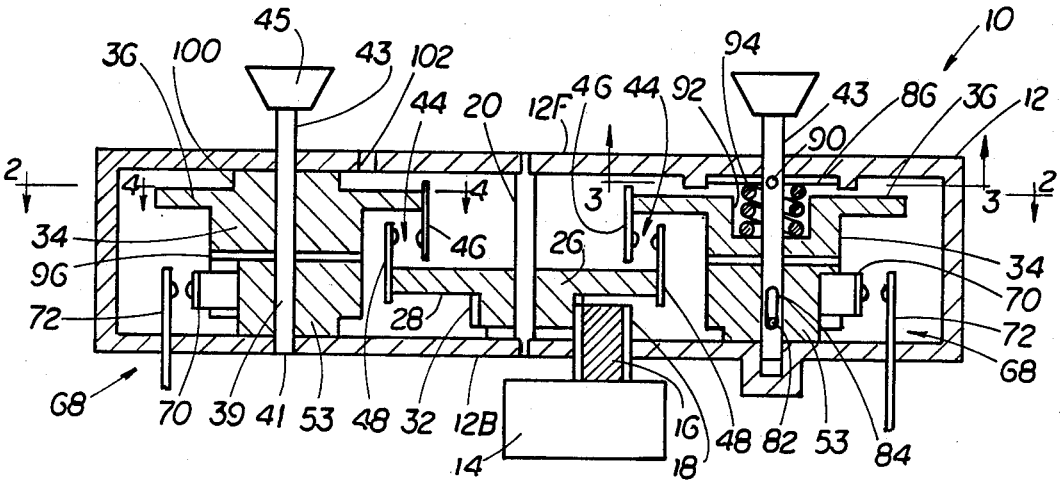
FIG. 1 is a cross-sectional side view of a preferred embodiment of a variable power control device of the present invention.
Figure 2:
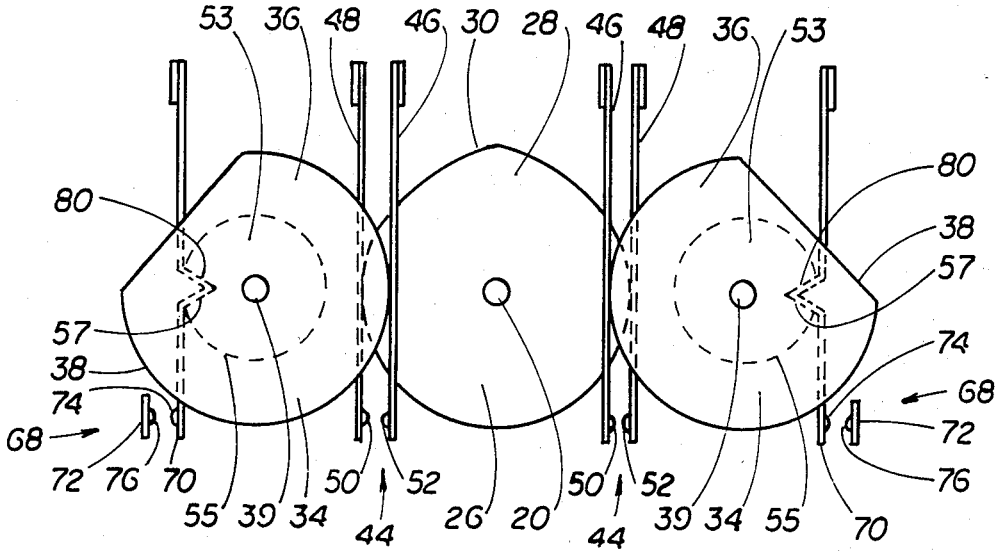
FIG. 2 is a cross-sectional top view of the embodiment of FIG. 1 as viewed in the direction of arrows 2—2 in FIG. 1.

With reference to FIGS. 1 and 2, there is shown an adjustable, variable power control device, generally denoted as the numeral 10, of the present invention. As shown, the control device 10 includes a housing 12 which encloses most of the various components of the control device.

A motor 14 having an output shaft 16 is located outside the housing 12 with its associated output shaft 16 extending into the interior of the housing 12 through an appropriate aperture formed through the back wall 12B of the housing 12. As illustrated, the output shaft 16 includes a pinion gear 18. The motor 14 is preferably a constant speed electric motor.

An axle 20 located within the housing 12 extends from the housing back wall 12B to the housing front wall 12F and is journal mounted at its opposite ends to the housing back wall 12B and housing front wall 12F. The longitudinal axis of the axle 20 is generally parallel to the rotational axis of the motor output shaft 16.

A cycle cam 26 is located within the housing 12 and affixed to the axle 20 for rotation with the axle 20. Toward this end, the cycling cam 26 is associated with the motor output shaft 16 so that it is driven by the output shaft 16 at a constant angular velocity. The cycling cam 26 is shown as comprising a radial disc cam body 28 formed with a contoured peripheral cam surface 30. Further, the cycling cam 26 includes a ring gear 32 coaxial with the axle 20. The ring gear 32 is in meshing engagement with the pinion gear 18 of the motor output shaft 16 so that the cycling cam 26 is driven at a constant angular velocity by the motor 14.

As shown, the adjustable, variable power control device 10 includes two set or adjustment cams 34 located to opposite sides of the cycling cam 26. The two adjustment cams 34 are identical, and, therefore for the sake of brevity, only one adjustment cam 34 will be discussed. Further, it should be understood that the number of adjustment cams 34 utilized in an adjustable, variable control device 10 of the present invention will be dictated by the number of electrical loads to be controlled by the device 10. For example, the control device 10 shown in FIGS. 1 and 2 having two adjustment cams 34 is meant to independently control two electrical loads. If four electrical loads were to be independently controlled, the device 10 would incorporate four adjustment cams 34 spaced about the cycling cam 26. The adjustment cam 34 includes a radial cam body 36 having a circumscribing contoured peripheral cam surface 38. The adjustment cam 34 located adjacent the cycling cam 26 with the radial cam body 36 of the adjustment cam 34 in spaced apart, parallel relationship to the cam body 28 of the cycling cam 26 and with a portion of the peripheral cam surface 38 of the adjustment cam 34 overlaying a portion of the peripheral cam surface 30 of the cycling cam 26. Further, the adjustment cam 34 is mounted for selective rotational movement about an axis generally parallel to the rotation of the cycling cam 26. Toward this end, the adjustment cam 34 is affixed to a shaft 39 for rotation therewith. The shaft 39 is generally parallel to the axle 20, is journal mounted at one of its ends 41 to the back wall 12B of the housing 12, and is journal mounted between its ends in an appropriate aperture in the front wall 12F of the housing 12. The end 43 of the shaft 39 opposite the journalled shaft end 41 extends to the exterior of the housing 12, and a hand manipulative knob 45 is attached to the extending shaft end 43 so that the shaft 39 can be selectively, manually rotated.

With continued reference to FIGS. 1 and 2, the control device 10 further includes a cycling electric contact switch, generally denoted as the numeral 44, operatively associated with the cycling cam 26 and the adjustment cam 34. The cycling electric contact switch 44 includes a first cantilevered movable contact arm 46 and a second cantilevered movable contact arm 48 mounted within the housing 12 so that the free ends of the contact arms are movable toward and away from each other. A contact point 50 is located at the free end of the first movable contact arm 46, and a contact point 52 is located at the free end of the second contact arm 48 in alignment with the contact point 50 across the gap between the free ends of the first and second contact arms 46 and 48. The first contact arm 46 is located at the contoured cam surface 38 of the adjustment cam 34 to follow the contour of the cam surface 38. The second contact arm 48 is disposed at the contoured cam surface 30 of the cycling cam 26 to follow the contour of the cam surface 30. Toward this objective, the first cantilevered cam arm 46 is resiliently biased toward and into contact with the cam surface 38 so that its free end having the contact point 50 will move in a motion, toward and away from the contact point 52 at the free end of the second contact arm 48, determined by the development or shape of the contoured cam surface 38 of the adjustment cam 34. Similarly, the second cantilevered cam arm 48 is resiliently biased toward and into contact with the cam surface 30 so that its free end having the contact point 52 will move in a motion, toward and away from the contact point 50 at the free end of the first contact arm 46, determined by the development or shape of the contoured cam surface 30 of the cycling cam 26.

With continuing reference to FIGS. 1 and 2, an on-off cam 53 is associated with the shaft 39 for rotation therewith. The on-off cam 53 includes a generally cylindrically shaped cam surface 55 concentric with the shaft 39, and a detent 57 formed at a predetermined location in the cam surface 55. An on-off electric contact switch, generally denoted as the numberal 68, is located in operative association with the on-off cam 53. The on-off contact switch 68 includes a cantilevered movable contact arm 70 movable toward and away from a stationary contact post 72. A contact point 74 is located at the free end of the movable contact arm 70, and a contact point 76 is located on the stationary contact post 72 in alignment with the contact point 74 across the gap between the free end of the contact arm 70 and stationary contact post 72. The cantilevered contact arm 70 is located at the cam surface 55 of the on-off cam 53 and is resiliently biased toward and into contact with the cam surface 55 so that the contact arm 70 will have a motion toward and away from the stationary contact post 72 as dictated by the cam surface 55 of the on-off switch 53. The cantilevered contact arm 70 also includes a protrusion 80 which is adapted to seat in the detent 57 in the cam surface 55 and adapted to ride against rhe cam surface 55 as the on-off cam is rotated. When the protrusion 80 of the movable contact arm 70 is seated in the detent 57, the free end of the contact arm 70 is allowed to move away from the stationary contact post 72 so that the contact point 74 on the arm 70 is spaced from and out of contact with the contact point 76 on the stationary post 72. As the on-off cam 53 is rotated by manual rotation of the shaft 39, the protrusion 80 is moved out of the detent 57 and onto the cylindrical cam surface 55 of the on-off cam 53 moving the free end of the contact arm 70 toward the stationary contact post 72, thus, moving the contact point 74 into contact with the contact point 76.

Figure 3:
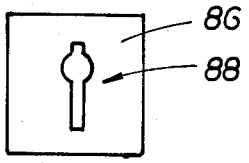
FIG. 3 is a view of a component of the device of FIG. 1 as viewed in the direction of arrows 3—3.

With continued reference to FIG. 1, two somewhat different configurations for the assembly of the adjustment cam 34, on-off cam 53 and shaft 39 are illustrated. In the assembly shown on the left in FIG. 1, the shaft 39 is mounted to the housing 12 so that it can be rotated about its longitudinal axis but will not move along its longitudinal axis. This construction is used in applications where it is desired to allow the manual turning of the shaft 39 by merely rotating the knob 45. In the assembly shown on the right in FIG. 1, the shaft 39 is mounted in the housing 12 so that it is both moveable about its longitudinal axis and along its longitudinal axis. This construction is used in applications where it is desired to provide a "push-to turn" feature, i.e., the shaft 39 must be pushed longitudinally before it can be rotated. As illustrated, in order to accomplish this "push-to-turn" feature, the on-off cam 53 is attached to the shaft 39 by means of a pin 82 which projects from the shaft 39 into an elongated slot 84 in the on-off cam 53. The long axis of the slot 84 is parallel to the longitudinal axes of the shaft 39. A stationary plate 86 (see FIG. 3) having a "key hole" shaped aperture 88 is located at the interior side of the housing front wall 12F. The shaft 39 is received through the circular portion of the "key hole" aperture 88 and a pin 90 affixed perpendicularly to the shaft 39 is adapted to be received in the stem portion of the "key hole" aperture 88. Further, the adjustment cam 34 is formed with a pocket 92 for receiving a compression spring 94 concentric with the shaft 39. In order to turn the shaft 39 about its longitudinal axis, the shaft 39 must be first pushed longitudinally to move the pin 90 out of its locked position in the "key hole" aperture 88. As the shaft 39 is moved longitudinally, the pin 82 moves along the elongated slot 84 in the on-off cam 53. With the shaft 39 moved longitudinally, it can now be rotated about its longitudinal axis, thus, rotating the adjustment cam 34 and on-off cam 53.

Figure 4:
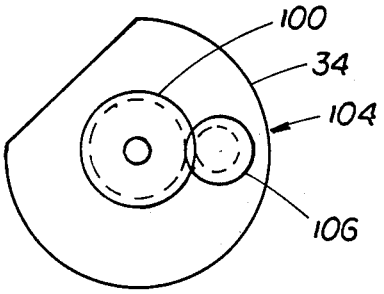
FIG. 4 is a view of another component of the device of FIG. 1 as viewed in the direction of arrows 4—4.

With continued reference to FIG. 1, the relative angular orientation between the adjustment cam 34 and on-off cam 53 about the shaft 39 can be selectively changed by clutch means, generally denoted as the numeral 96. The clutch means 96 is shown as comprising a friction surface disposed at the interface of the adjustment cam 34 and on-off cam 53, and affixed to one or the other of the on-off cam 53 or adjustment cam 34. The adjustment cam 34 can be rotated about the longitudinal axis of the shaft 39 relative to the fixed position of the on-off cam 52. Various means can be provided to accomplish the rotation ot the adjustment cam 34. For example, as shown in FIGS. 1 and 4, the top side of the cam body 36 of the adjustment cam 34 is formed with, for example, a ring gear 100, and a small aperture is formed in the housing front wall 12F to receive a tool 104 having a pinion gear 106. To rotate the adjustment cam 34 relative to the on-off cam 53 about the shaft 39, the tool 104 is inserted through the aperture 102 placing the pinion gear 106 in meshing engagement with the ring gear 100. The pinion gear 106 is turned, thus, causing the adjustment cam 34 to rotate about the shaft 39 changing the relative angular displacement of the adjustment cam 34 and on-off cam 53.

Figure 5:
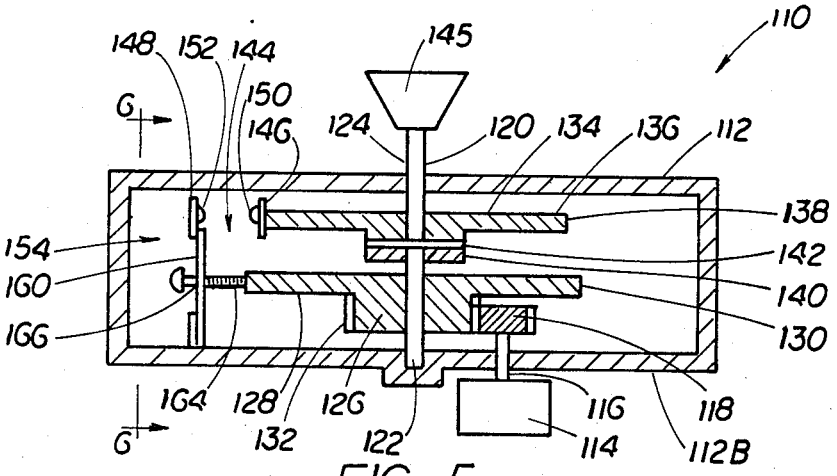
FIG. 5 is a cross-sectional front view of another embodiment of a variable power control device of the present invention.
Figure 6:
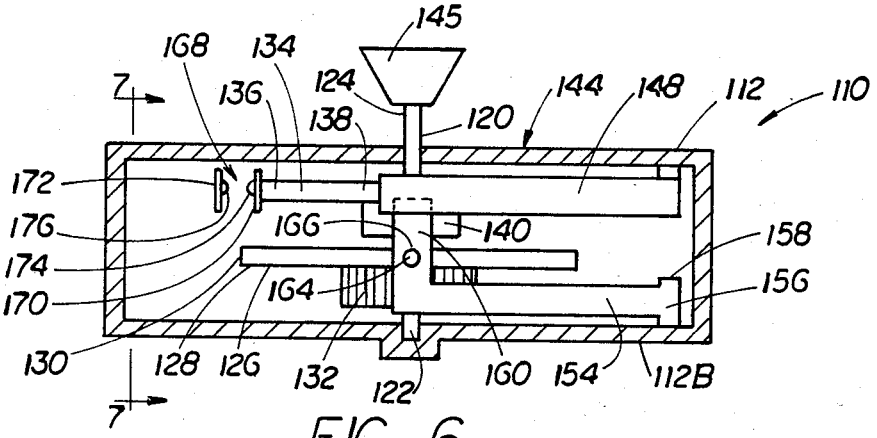
FIG. 6 is a cross-sectional side view of the control device of FIG. 5 as viewed in the direction of arrows 6—6.
Figure 7:
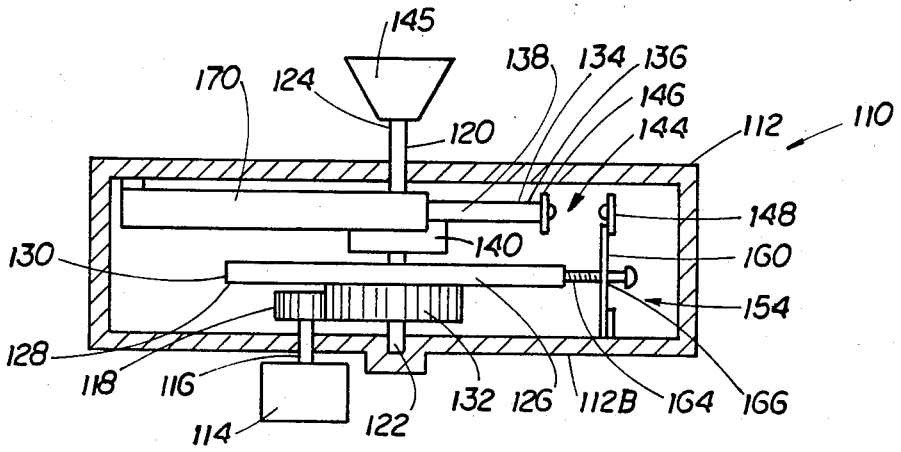
FIG. 7 is a cross-sectional rear view of the control device for FIG. 5 as viewed in the direction of arrows 7—7.

FIGS. 5 through 7 illustrate another advantageous embodiment of the adjustable, variable power control unit of the present invention, generally denoted as the numeral 110. As shown, the control unit 110 includes a housing 112 which encloses the various components of the control device.

A motor 114 having an output shaft 116 is located outside the housing 112 with its associated output shaft 116 extending into the interior of the housing 112 through an appropriate aperture formed through the back wall 112B of the housing 112. As illustrated, the output shaft 116 includes a pinion gear 118. The motor 114 is preferably a constant speed electric motor.

An axle 120 is journal mounted within the housing 112 extending from the housing back wall 112B and through the housing front wall to the exterior of the housing 112. The longitudinal axes of the axle 120 is generally parallel to the rotational axes of the motor output shaft 116. As shown, one end 122 of the axle 120 is journalled at the housing back wall 112B and extends through an appropriate aperture in the housing front wall 112F such that the other end 124 of the axle 120 projects to the exterior of the housing 112. A manually manipulated knob 145 is fastened to the projecting axle end 124 so that as the knob 145 is turned, the axle 120 will turn therewith.

A cycling cam 126 is located within the housing 112 and is journal mounted on the axle 120 for rotation about the longitudinal axis of the axle 120. The cycling cam 126 is shown comprising a radial disc cam body lZ8 formed with a contoured peripheral cam surface 130. Further, the cycling cam 126 includes ring gear 132 coaxial with the rotational axes of the axle 120. The ring gear 132 is in meshing engagement with the pinion gear 118 of the motor output shaft 116 so that the cycling cam 126 is driven at a constant angular velocity about the longitudinal axis of the axle 120 by the motor 114.

At least one set or adjustment cam 134 is located within the housing 112 and affixed to the axle 120 for rotation with the axle 120. The adjustment cam 134 is shown as being located adjacent to the cycling cam 126. The adjustment cam 134 is shown as comprising a radial disc cam body 136 formed with a contoured peripheral cam surface 138. Further, the adjustment cam 134 includes a boss 140 with an appropriate aperture for receiving a pin 142 attaching the set cam 134 to the axle 120. Thus, the contoured peripheral cam surface 130 of the cycling cam 126 moves about the axle 120 in a plane generally parallel to the contoured peripheral cam surface 138 of the set cam 134.

With continued reference to FIGS. 5 through 7, the control device 110 includes a cycling electric contact switch, generally denoted as the numeral 144, operatively associated with the cycling cam 126. The cycling contact switch 144 is located at the contoured, peripheral cam surface 138 of the adjustment cam 134. As shown, the cycling contact switch 144 includes a first movable cantilevered contact arm 146 adjacent the contoured peripheral cam surface 138 of the adjustment cam 134, and a second movable cantilevered contact arm 148 in parallel juxtaposition to the first movable contact arm 146. A contact point 150 is located at the free end of the first movable contact arm 146, and a contact point 152 is located at the free end of the second contact arm 148 in alignment with the contact point 150 across the gap between the first and second contact arms 146 and 148. The first cantilevered contact arm 146 is resiliently biased toward and into contact with the cam surface 138 of the adjustment cam 134 so its free end having the contact point 150 will move in a motion, toward and away from the contact point 152 of the second contact arm 148, as determined by the development or shape of the contoured cam surface 138 of the adjustment cam 134. A cycling cam follower arm 154 is located adjacent the contoured peripheral cam surface 130 of the cycling cam 126 in generally parallel alignment with the second movable contact arm 148 of the cycling contact switch 144. The cycling cam follower arm 154 is pivotably connected at one of its ends 156 to the housing back wall 112B by means of a pivot pin 158, such that the free end 160 of the cycling cam follower arm 154 is in alignment with the free end of the second contact arm 148 of the cycling contact switch 144. The cycling cam follower arm 154 has an upwardly projecting finger 160 near its free end. The finger 160 extends upwardly into the space between the first and second contact arms 146 and 148 of the cycling contact switch 144 and into contact with the second movable contact arm 148 on the side of the second movable contact arm 148 facing toward the first movable contact arm 146. The second movable contact arm 148 is resiliently biased toward the first movable contact arm 146 and, therefore, into continuous contact with the finger 160 of the cycling cam follower arm 154. The cycling cam follower arm 154 also includes a cam surface contact projection 164 which rides against the contoured, peripheral cam surface 130 of the cycling cam 126. As shown, the contact projection 164 is a threaded screw received through a threaded aperture in the cycling cam follower arm 154 such that one end of the threaded screw 164 is in contact with the cam surface 130 of the cycling cam 126. As the screw 164 is threaded into the threaded aperture 166 in the follower arm 154, the free end of the screw 164 increasingly extends through the aperture 166 pushing against the cam surface 130 thus reacting with the follower arm 154 to move the finger 160 in a direction away from the first contact arm 146 and because of the contact between the finger 160 and second contact arm 148 causing the free end of the second movable contact arm 148 of the cycling contact switch 144 to move away from the free end of the first movable contact arm 146 of the cycling contact switch 144 thereby increasing the gap between the contact point 150 and 152 on the contact arms 146 and 148. As the screw 164 is threaded out of the threaded aperture 166, the free end of the screw 164 decreasingly extends through the aperture 166 and, because the second contact arm 148 is biased toward the first contact arm 146, allows the second contact arm 148 to move toward the first contact arm 146 thereby closing the gap between the contact point 150 and 152 on the contact arms 146 and 148. As the cycling cam 126 is rotated about the axle 120 by the motor 114, the cycling cam follower arm 154 will move in a motion determined by the development or shape of the contoured cam surface 130 of the cycling cam 126. This motion of the cam follower arm 154 is transmitted to the second moveable contact arm 148 of the cycling contact switch 144 so that the free end of the second contact arm 148 having the contact point 1152 will move in a motion, toward and away from the contact point 150 on the first contact arm 146 of the switch 144, determined by the development or shape of the contoured cam surface 130 of the cycling cam 126.

Still referring to FIGS. 5 through 7, the control device 110 also includes an on-off contact switch 168 located next to the cam surface 138 of the adjustment cam 134. The on-off contact switch 168 includes a movable cantilevered contact arm 170 movable toward and away from a stationary contact post 172. A contact point 174 is located at the free end of the movable contact arm 170, and a contact point 176 is located of the stationary contact post 172 in alignment with the contact point 174 across the gap between the free end of the contact arm 170 and stationary contact post 172. The cantilevered contact arm is located at the cam surface 138 of the set or adjustment cam 134 and is resiliently biased toward and into contact with the set cam surface 138 so that the contact arm 170 will have a motion toward and away from the stationary contact post 172 as dictated by the development of the adjustment cam surface 134. Thus, as the adjustment cam 134 is caused to rotate with the axle 120 upon manual manipulation of the knob 145, the movable contact arm 170 will move toward the stationary contact post 172, thus, moving the contact point 174 into contact with the contact point 176. As the adjustment cam 134 is caused to move beyond this setting, the movable contact arm 170 will move away from the stationary contact post 172, thus, moving the contact point 174 away from and out of contact with the contact point 176.

Figure 8:
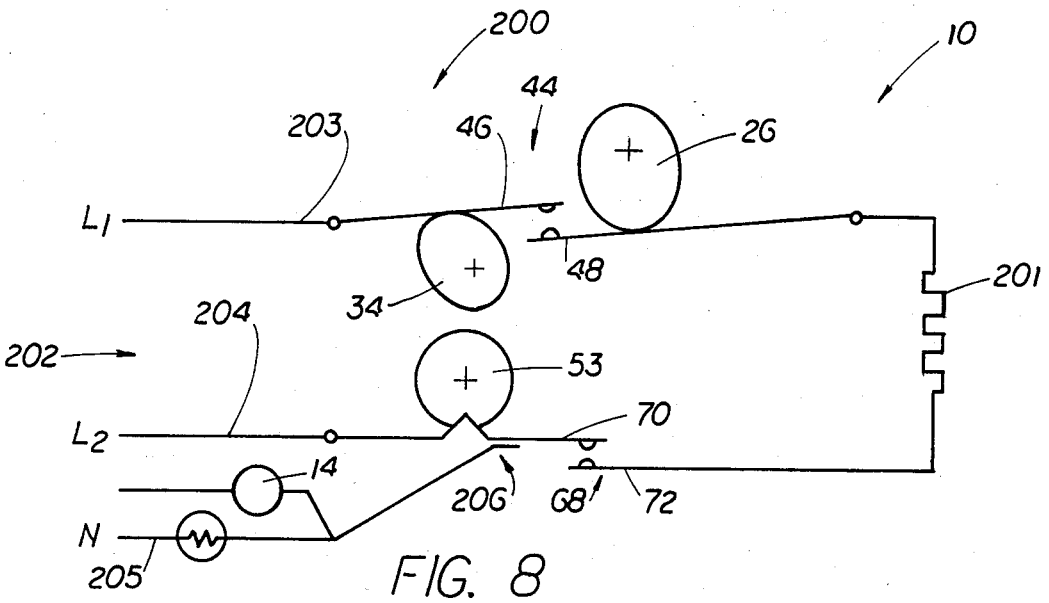
FIG. 8 is a schematic representation of the control device of FIGS. 1—2 included in an electrical circuit.

Now with reference to FIG. 8, there is shown, in schematic form, a control circuit, generally denoted as the numeral 200, incorporating the adjustable, variable power device 10 of the present invention. The electrical control circuit 200 includes an electrical load 201 operatively connected to a power source 202 by means of electrical conductors 203 and 204, and the electric motor 14 operatively connected to the power source 202 by means of the electrical conductor 204 and to neutral by a conductor 205. The cycling electrical contact switch 44 is located in the electrical conductor 203 to selectively open and close the conductor 203. The set or adjustment cam 34 is manually rotated to a predetermined position moving the contact arm 46 away from or toward the contact arm 48 to create a gap therebetween of a predetermined amount or to close the gap. The on-off contact switch 68 is located in the other electric conductor 204 to selectively open and close the electric conductor 204. As the on-off cam 53 is manually rotated to a predetermined position, the gap between the movable contact arm 70 and the stationary contact post 72 is closed. A third contact switch 206 is included in the conductor 205 to close the circuit to the motor 14 upon closing of the on-off switch 68 by the on-off cam 53. Thus, as the on-off switch 68 is closed upon rotation of the on-off cam 53, the motor 14 is started and rotatably drives the cycling cam 26 at a constant angular velocity. As the cycling cam 26 rotates, its contoured cam surface 30 causes the contact arm 48 of the cycling contact switch 44 to move into and out of contact with the contact arm 46 of the cycling contact switch 44 periodically and for a duration dictated by the particular configuration of the contoured cam surface 30. As the cycling contact switch 44 closes, current flows through the conductor 203 activating the electric load 201, and as the cycling contact switch 44 opens, current is prevented from flowing through the conductor 203 deactivating the electric load 201.

Figure 9:
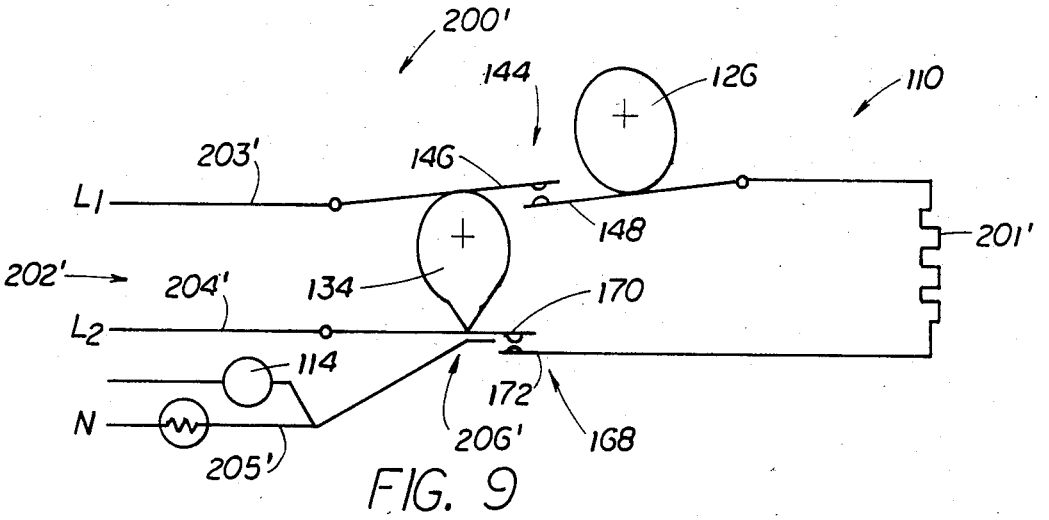
FIG. 9 is a scematic representation of the control device of FIGS. 5—7 included in an electrical circuit; and, FIG. 10 is a graph depicting a duty cycle of the present invention.

Turning now to FIG. 9, there is shown, in schematic form, a control circuit, generally denoted as the numeral 200', incorporating the adjustable, variable power control device 110 of the present invention. The electrical control circuit 200' includes an electric load 201' operatively connected to a power source 202' by means of electrical conductors 203' and 204', and the electric motor 114 operatively connected to the power source 202' by means of the electrical conductor 204' and to neutral by a conductor 205'. The cycling electrical contact switch 144 is located in the electrical conductor 203' to selectively open and close the conductor 203'. The set or adjustment cam 134 is manually rotated to a predetermined position moving the contact arm 146 away from or toward the contact 148 to create a gap therebetween of a predetermined amount or to close the gap, respectively. The on-off contact switch 168 is located in the other electrical conductor 204' to selectively open and close the electrical conductor 204'. As the set or adjustment cam 134 is manually moved to a predetermined second position, the gap between the movable contact arm 170 and stationary contact post 172 is closed. A third contact switch 206' is included in the electric conductor 205' to close the circuit to the motor 114 upon closing of the on-off contact switch 168 by the set or adjustment cam 134. Thus, as the on-off switch 168 is closed, the motor 114 is started and rotatably drives the cycling cam 126 at a constant angular velocity. As the cycling cam 126 rotates, its contoured cam surface 130 causes the contact arm 148 of the cycling contact switch 144 to move into and out of contact with the contact arm 146 of the cycling contact switch 144 periodically and for a duration dictated by the particular configuration of the contoured cam surface 130. As the cycling contact switch 144 closes, current flows through the conductor 203' activating the electric load 201', and as the cycling contact switch 144 opens, current is prevented from flowing through the conductor 203' deactivating the electric load 201'.

Figure 10:
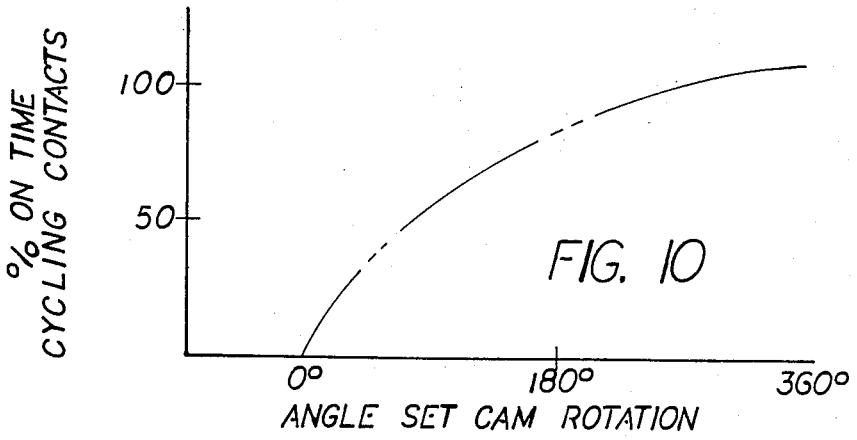

FIG. 10 illustrates, by way of example, a plot of the percent on time of the cycling contact switch 44, 144 (i.e. that time during which the contacts 46–48 and 146–148 are in contact) versus the angular position of the adjustment or set cam 34, 134 from an arbitrary datum point at which position the adjustment cam 34,134 will prevent the contacts 46–48 and 146–148 from closing regardless of the angular position of the cycling cam 26, 126.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A variable, adjustable control device for variably controlling the duty cycle for an electrical load comprising:

electrical cycling contact switch means having two movable contact arms adapted for movement toward and away from each other; a rotatable cycling cam means operatively associated with one of the contact arms of the cycling contact switch means for opening and closing the gap between the movable contact arms of the cycling contact switch means as a function of the development of the cam surface of the cycling cam means;

motor means for rotating the cycling cam means at a constant angular velocity;

on-off contact switch means operatively associated with means;

on-off rotatable cam means operatively associated with the on-off contact switch means for opening and closing the on-off switch means; and, rotatable adjustment cam means operatively associated with the outer one of the movable contact arms of the cycling contact switch means for adjusting the gap between the contacts of the movable contact arms of the cycling switch means as a function of the development of the the cam surface of the adjustable cam means.

2. The control device of claim 1, wherein the cam means operatively associated with the on-off contact switch means is manually rotatably positioned.

3. The control device of claim 1, wherein the adjustment cam means operatively associated with the cycling contact switch means is manually rotatably positioned.

4. The control device of claim 1, wherein the rotatable axis of the rotatable cycling cam means is generally parallel to the rotational axis of the rotatable adjustment cam means.

5. The control device of claim 1, wherein the two movable contact arms of the cycling contact switch are biased in direction toward each other .

6. The control device of claim 1, wherein the on-off contact switch means comprises:

a movable contact;

a stationary contact; and, the movable contact being operatively associated with the cam means for movement toward and away from the stationary contact as dictated by the development of the cam surface of the. cam means.

7. The control device of claim 1, wherein:

the rotatable cycling cam means includes a peripheral cam surface; and, the rotatable adjustment cam means includes a peripheral. cam surface.

8. The control device of claim 7 wherein:

a portion of the peripheral cam surface of the adjustment cam means overlays a portion of the peripheral cam surface of the cycling cam means.

9. The control device of claim 7, wherein the peripheral cam surface of the adjustment cam means and the peripheral cam surface of the cycling cam means rotate in generally parallel planes.

10. The control device of claim 1, wherein the rotational axis of the rotatable cam mean associated with the on-off contact switch means is coaxial with the rotational axis of the rotatable adjustment cam means.

11. The control device of claim 10, further comprising means for selectively changing the relative angular orientation of the adjustment cam means relative to the on-off cam means about the common rotational axis.

12. The control device of claim 1, wherein the rotational axis of the rotatable cycling cam means is coaxial with the rotational axis of the rotatable adjustment cam means.

13. The control device of claim 12, wherein the rotatable cycling cam means and rotatable adjustment cam means are rotatable independently of one another.

14. The control device of claim 13, further comprising:

the cycling contact switch means includes first and second movable contacts adapted for movement toward and away from each other; and, a cycling cam follower arm in contact with the cycling cam means for movement following the cam surface of the cycling cam means and in contact with one of the movable cycling contacts for moving that movable contact toward and away from the other movable contact of the cycling switch means as dictated by the development of the cam surface of the cycling cam means.

15. The control device of claim 14, further comprising adjustable cam surface contact means associated with the cycling cam follower arm for adjusting the position of the follower arm relative to the cam surface of the cycling cam means.

16. The control device of claim 12, comprising:

an axle mounted for rotation about its longitudinal axis;

the cycling cam means being located on the axle for rotation about the longitudinal axis of the axle independent of rotation of the axle; and, the adjustment cam means being located on the axle for rotation with the axle.

17. The control device of claim 1, wherein:

the cycling cam means included a ring gear; and, the motor means includes a driven pinion gear in mesh with the ring gear of the cycling cam means.

18. A variable, adjustable control device comprising:

a plurality of cycling contact switched each attached to a different load;

a rotatable cycling cam operatively associated with the plurality of cycling contact switches for opening and closing the cycling contact switches as a function of the development of the cam surface of the cycling cam;

motor means for rotating the cycling cam at a constant angular velocity; and, a plurality of rotatable adjustment cams equal in number to the number of cycling contact switches, each adjustment cam being operatively associated with a different one of the cycling contact switches for adjusting the gap between the contacts of the associated cycling contact switch as a function of the development. of the cam surface of the adjustment cam.

19. A variable, adjustable control device comprising:

at least one cycling contact switch having two movable contact arms adapted for movement toward and away from each other;

a rotatable cycling cam operatively associated with one of the movable contact arms of the at least one cycling contact switch for opening and closing the gap between the movable contact arms of the cycling contact switch as a function of the development of the cam surface of thecycling cam;

motor means for rotating the cycling cam at a constant angular velocity; and, a rotatable adjustment cam coaxially disposed with the rotational axis of the cycling cam and rotatable independently of the cycling cam, the adjustment cam being operatively associated with the other one of the movable contact arms of the at least one cycling contact switch for adjusting the gap between the movable contact arms of the at least one cycling contact switch.

* * * * *